US011812908B2

(12) United States Patent
Yang

(10) Patent No.: US 11,812,908 B2
(45) Date of Patent: Nov. 14, 2023

(54) LIQUID STORAGE DEVICE AND CLEANING APPARATUS

(71) Applicant: SHENZHEN FLY RODENT DYNAMICS INTELLIGENT TECHNOLOGY CO., LTD., Shenzhen (CN)

(72) Inventor: Jun Yang, Shenzhen (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 128 days.

(21) Appl. No.: 17/548,857

(22) Filed: Dec. 13, 2021

(65) Prior Publication Data

US 2022/0378272 A1 Dec. 1, 2022

(30) Foreign Application Priority Data

May 27, 2021 (CN) ..... 202121163851.X
May 27, 2021 (CN) ..... 202121169828.1

(51) Int. Cl.
*A47L 11/40* (2006.01)
*B65D 37/00* (2006.01)

(52) U.S. Cl.
CPC ..... *A47L 11/4083* (2013.01); *A47L 11/4016* (2013.01); *A47L 11/4088* (2013.01); *B65D 37/00* (2013.01)

(58) Field of Classification Search
CPC ..... A47L 11/4083; A47L 11/4016; A47L 11/4088; A47L 11/408
See application file for complete search history.

(56) References Cited

U.S. PATENT DOCUMENTS

2009/0270545 A1* 10/2009 Sahnoune ..... C08L 23/14 524/476
2014/0291330 A1* 10/2014 Crocker ..... A47L 11/4083 220/528

FOREIGN PATENT DOCUMENTS

| | | | |
|---|---|---|---|
| CN | 208472632 | U | 2/2019 |
| CN | 208958019 | U | 6/2019 |
| CN | 209529057 | U | 10/2019 |
| CN | 110638383 | A | 1/2020 |
| CN | 211933903 | U | 11/2020 |

(Continued)

OTHER PUBLICATIONS

Machine translation: CN110811444A; Li et al. (Year: 2020).*
International Search Report of PCT Patent Application No. PCT/CN2021/137283 dated Mar. 10, 2022.

*Primary Examiner* — Natasha N Campbell
(74) *Attorney, Agent, or Firm* — IPRO, PLLC; Na Xu

(57) ABSTRACT

A liquid storage device includes a first liquid storage structure, a second liquid storage structure, and a liquid guiding assembly. The second liquid storage structure is arranged inside the first liquid storage structure, and the second liquid storage structure is flexible and includes a variable volume. A space between a structural wall of the first liquid storage structure and a structural wall of the second liquid storage structure is configured to store a first liquid, and the second liquid storage structure is configured to store a second liquid. The second liquid is capable of flowing into or flowing out of the second liquid storage structure through the liquid guiding assembly.

18 Claims, 5 Drawing Sheets

(56) References Cited

FOREIGN PATENT DOCUMENTS

| | | | | | |
|---|---|---|---|---|---|
| CN | 110811444 | B | * | 6/2021 | ..... A47L 11/29 |
| FR | 3006877 | A1 | | 12/2014 | |

* cited by examiner

LIQUID STORAGE DEVICE AND CLEANING APPARATUS

CROSS-REFERENCE TO RELATED APPLICATIONS

The present disclosure claims priority of Chinese Patent Application No. 202121169828.1, filed on May 27, 2021, titled "liquid storage device and cleaning apparatus", and claims priority of Chinese Patent Application No. 202121163851.X, filed on May 27, 2021, titled "liquid storage device and cleaning apparatus", the contents of both of which are incorporated herein by reference.

TECHNICAL FIELD

The present disclosure relates to the field of cleaning technology, and in particular, relates to a liquid storage device and a cleaning apparatus.

BACKGROUND

A typical cleaning apparatus, such as a cleaning robot for mopping or washing floor, or a station for maintaining cleaning robots, is equipped with two water storage tanks, one of which is used to store clear water and the other is used to store waste liquid. Because the cleaning apparatus is equipped with two water storage tanks, the cleaning apparatus occupies a large volume and the construction cost thereof is high.

SUMMARY

An embodiment of the present disclosure provides a liquid storage device. The liquid storage device includes a first liquid storage structure, a second liquid storage structure, and a liquid guiding assembly. The second liquid storage structure is arranged inside the first liquid storage structure, and the second liquid storage structure is flexible and includes a variable volume. A space between a structural wall of the first liquid storage structure and a structural wall of the second liquid storage structure is configured to store a first liquid, and the second liquid storage structure is configured to store a second liquid. The second liquid is capable of flowing into or flowing out of the second liquid storage structure through the liquid guiding assembly.

Another embodiment of the present disclosure provides a cleaning apparatus. The cleaning apparatus includes the above mentioned liquid storage device and a cleaning unit. The second liquid is capable of being supplied from the second liquid storage structure through the liquid guiding assembly to the cleaning unit.

BRIEF DESCRIPTION OF THE DRAWINGS

In order to explain technical solutions in embodiments of the present disclosure more clearly, attached drawings required in the description of the embodiments or the related art will be briefly introduced below. Obviously, the attached drawings in the following description are only some embodiments of the present invention. For those of ordinary skill in the art, other drawings can be obtained according to these attached drawings without creative labor.

DETAILED DESCRIPTION

In order to make technical problems, technical solutions and beneficial effects to be solved in the present disclosure clearer, the present disclosure will be further explained in detail below with reference to attached drawings and embodiments. It shall be understood that the specific embodiments described here are only used to explain the present disclosure, and are not used to limit the present disclosure.

It shall be noted that when an element is said to be "fixed" or "positioned" on another element, it may be directly or indirectly on the another element. When an element is said to be "connected" to another element, it may be directly or indirectly connected to the another element.

It shall be understood that, orientations or position relationships indicated by terms such as "length", "width", "upper", "lower", "front", "back", "left", "right", "vertical", "horizontal", "top", "bottom", "inside" and "outside" or the like are orientations or position relationships shown based on the attached drawings, and these terms are only used to facilitate the description of the present disclosure and for brief description, and do not indicate or imply that the device or element described must have a specific orientation, must be constructed and operated in a specific orientation, and thus these terms should not be understood as limitation to the present disclosure.

In addition, terms "first" and "second" are only used for descriptive purposes, and should not be understood as indicating or implying relative importance or implicitly indicating the number of indicated technical features. Thus, features defined with "first" and "second" may explicitly or implicitly include one or more of the features. In the description of the present disclosure, "plural" means two or more than two, unless otherwise specifically defined.

The liquid storage device and the cleaning apparatus according to the embodiments of the present disclosure will now be described.

Figure 1:
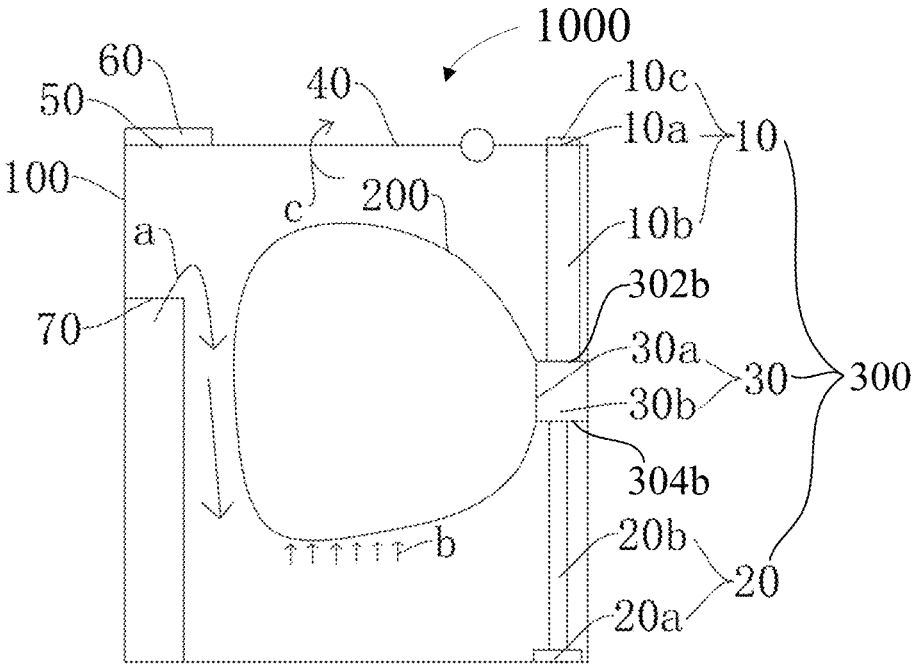
FIG. 1 is a schematic view of a liquid storage device according to an embodiment of the present disclosure.
Figure 2:
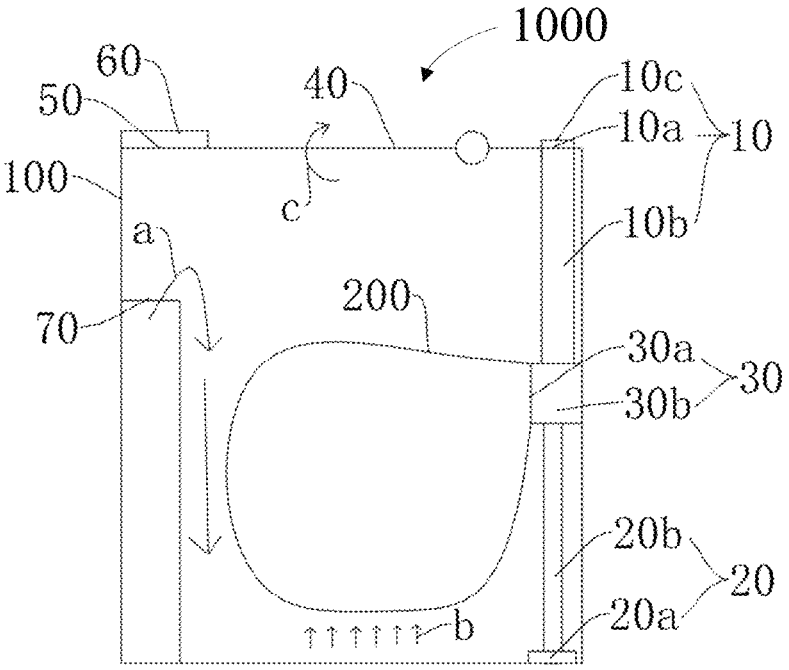
FIG. 2 is a schematic view of the liquid storage device of FIG. 1, but in another state.

Referring to FIG. 1 and FIG. 2, an embodiment of the present disclosure provides a liquid storage device 1000. The liquid storage device 1000 includes a first liquid storage structure 100, a second liquid storage structure 200, and a liquid guiding assembly 300. The second liquid storage structure 200 is positioned inside the first liquid storage structure 100, and the second liquid storage structure 200 has flexibility and a variable volume. The liquid guiding assembly 300 is configured to allow the second liquid to flow into or flow out of the second liquid storage structure 200. The space between the structural wall of the first liquid storage structure 100 and the structural wall of the second liquid storage structure 200 is configured to store a first liquid, and the second liquid storage structure 200 is configured to store a second liquid. The liquid guiding assembly 300 includes a liquid inlet structure 10, a liquid outlet structure 20 and a liquid guiding structure 30. The liquid inlet structure 10 communicates with the liquid guiding structure 30, and the second liquid can flow into the second liquid storage structure 200 through the liquid inlet structure 10 and the liquid guiding structure 30. The liquid outlet structure 20 communicates with the liquid guiding structure 30, and the second liquid can flow out of the second liquid storage structure 200 through the liquid outlet structure 20 and the liquid guiding structure 30.

In the liquid storage device 1000 provided by the above embodiment, the second liquid may be stored in the second liquid storage structure 200, and the first liquid may be stored in the space between the structural wall of the first liquid storage structure 100 and the structural wall of the second liquid storage structure 200. Because the structural wall of the second liquid storage structure 200 is flexible, the volume of the second liquid storage structure 200 is variable. With the decrease of the second liquid in the second liquid storage structure 200, the volume of the second liquid storage structure 200 is decreased, while the storage space between the structural wall of the second liquid storage structure 200 and the structural wall of the first liquid storage structure 100 is increased, such that the liquid storage device can store more first liquid. On the contrary, with the increase of the second liquid in the second liquid storage structure 200, the volume of the second liquid storage structure 200 increases, while the storage space between the structural wall of the second liquid storage structure 200 and the structural wall of the first liquid storage structure 100 decreases, such that the liquid storage device 1000 can store more second liquid. In this way, the first liquid and the second liquid are stored in one box by alternately increasing and decreasing the first liquid and the second liquid, thus avoiding the solution that two water storage tanks are required in the related art, and reducing the occupied volume and the construction cost of the liquid storage device.

The liquid inlet structure 10 includes a liquid inlet opening 10*a* and a liquid inlet pipe 10*b*. The liquid inlet opening 10*a* is defined on the structural wall of the first liquid storage structure 100, one end of the liquid inlet pipe 10*b* communicates with the liquid inlet opening 10*a*, and the other end of the liquid inlet pipe 10*b* communicates with the liquid guiding structure 30. The liquid outlet structure 20 includes a liquid outlet opening 20*a* and a liquid outlet pipe 20*b*. The liquid outlet opening 20*a* is defined on the structural wall of the first liquid storage structure 100, one end of the liquid outlet pipe 20*b* communicates with the liquid outlet opening 20*a*, and the other end of the liquid outlet pipe 20*b* communicates with the liquid guiding structure 30.

More specifically, the liquid inlet opening 10*a* is defined on the top wall of the first liquid storage structure 100, and the liquid inlet pipe 10*b* extends linearly along the height direction of the liquid storage device 1000. The liquid outlet opening 20*a* is defined on the bottom wall of the first liquid storage structure 100, and the liquid outlet pipe 20*b* extends linearly along the height direction of the liquid storage device 1000.

In this embodiment, the liquid guiding structure 30 includes a liquid guiding opening 30*a* and a liquid guiding sleeve 30*b*. The liquid guiding opening 30*a* is defined on the structural wall of the second liquid storage structure 200, and the liquid guiding opening 30*a* is positioned opposite to the side wall of the first liquid storage structure 100. One end of the liquid guiding sleeve 30*b* is connected to the side wall of the first liquid storage structure 100, and the other end of the liquid guiding sleeve 30*b* communicates with the liquid guiding opening 30*a*. The wall of the liquid guiding sleeve 30*b* defines a first communication opening 302*b* and a second communication opening 304*b*, the first communication opening 302*b* communicates with the liquid inlet pipe 10*b*, and the second communication opening 304*b* communicates with the liquid outlet pipe 20*b*. More specifically, the liquid guiding structure 30 is centrally arranged along the height direction of the liquid storage device.

As shown in FIG. 2, the second liquid enters the second liquid storage structure 200 through the liquid inlet structure 10. The second liquid storage structure 200 spreads out and stores the second liquid. Due to the gravity of the second liquid, the second liquid storage structure 200 on the whole is close to the bottom wall of the first liquid storage structure 100. As shown in FIG. 1, as the second liquid is led out of the second liquid storage structure 200 through the liquid outlet structure 20, and the first liquid enters the first liquid storage structure 100 through the liquid inlet 70 of the first liquid storage structure 100, the first liquid forms a buoyancy support for the second liquid storage structure 200, and the second liquid storage structure 200 gradually moves away from the bottom wall of the first liquid storage structure 100. The first liquid may hold up the second liquid storage structure 200 such that the second liquid storage structure 200 and the liquid guiding structure 30 are approximately at the same horizontal plane, thereby reducing the load of the liquid guiding opening 30*a* and facilitating the outflow of all the second liquid in the second liquid storage structure 200. The direction "a" shown in FIG. 1 and FIG. 2 is the direction in which the first liquid enters the first liquid storage structure 100 from the liquid inlet 70, and the direction "b" is the buoyancy supporting direction of the first liquid to the second liquid storage structure 200.

Figure 3:
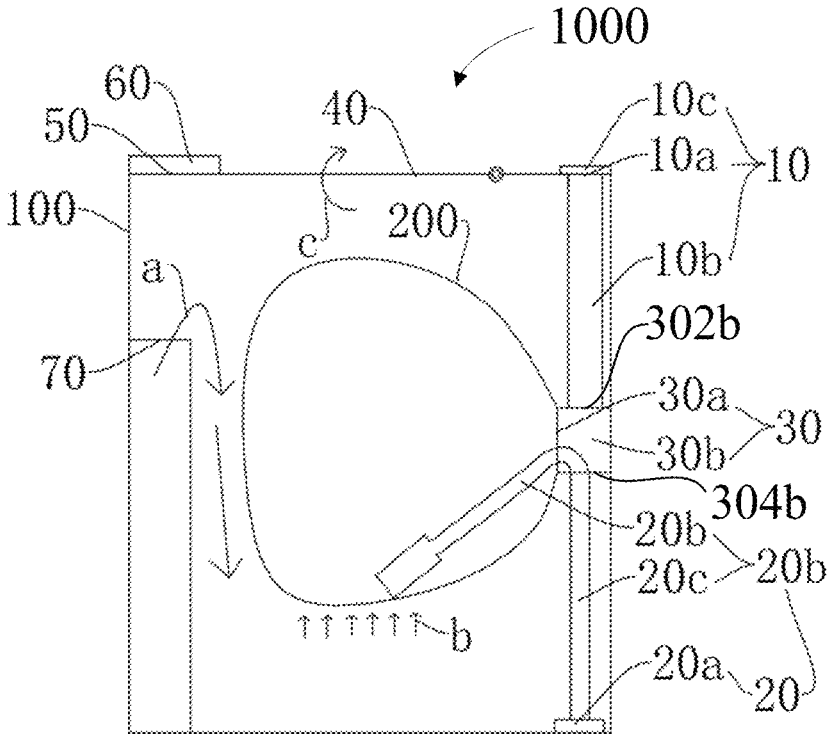
FIG. 3 is a schematic view of the liquid storage device according to some embodiments of the present disclosure.
Figure 4:
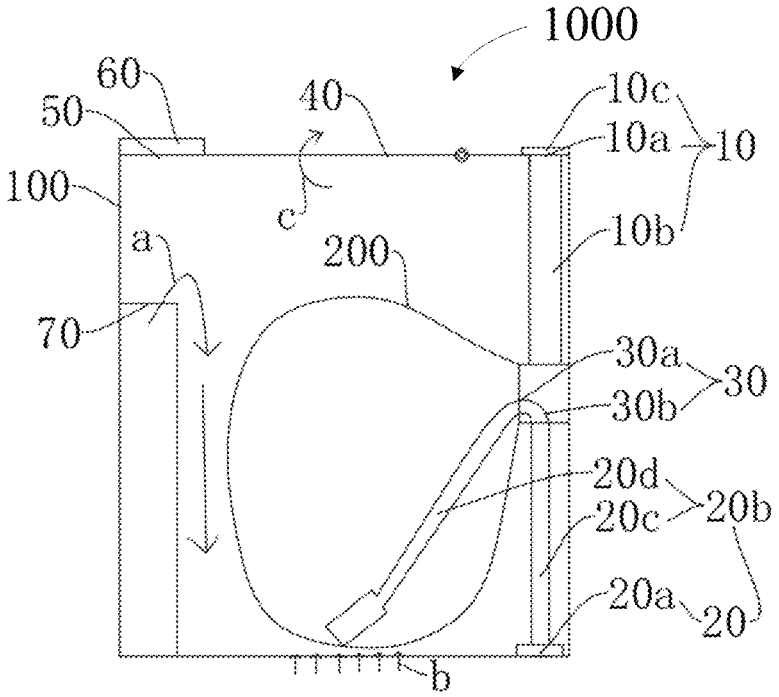
FIG. 4 is a schematic view of the liquid storage device of FIG. 3, but in another state.

As shown in FIG. 3 and FIG. 4, in some embodiments, the liquid inlet structure 10 includes a liquid inlet opening 10*a* and a liquid inlet pipe 10*b*. The liquid inlet opening 10*a* is defined on the structural wall of the first liquid storage structure 100, one end of the liquid inlet pipe 10*b* communicates with the liquid inlet opening 10*a* and the other end of the liquid inlet pipe 10*b* communicates with the liquid guiding structure 30. The liquid outlet structure 20 includes a liquid outlet opening 20*a* and a liquid outlet pipe 20*b*. The liquid outlet opening 20*a* is defined on the structural wall of the first liquid storage structure 100, one end of the liquid outlet pipe 20*b* communicates with the liquid outlet opening 20*a*, and the other end of the liquid outlet pipe 20*b* passes through the liquid guiding structure 30 and extends into the second liquid storage structure 200.

More specifically, the liquid inlet opening 10*a* is defined on the top wall of the first liquid storage structure 100, and the liquid inlet pipe 10*b* extends linearly along the height direction of the liquid storage device 1000. The liquid outlet opening 20*a* is defined on the bottom wall of the first liquid storage structure 100. The liquid outlet pipe 20*b* includes a first pipe section 20*c* and a second pipe section 20*b* communicating with the first pipe section 20*c*, and the joint of the first pipe section 20*c* and the second pipe section 20*b* is in a curved transition. The first pipe section 20*c* extends linearly along the height direction of the liquid storage device 1000, and an end of the second pipe section 20*b* that is away from the first pipe section 20*c* extends into the second liquid storage structure 200. The curved transition of the first pipe section 20*c* and the second pipe section 20*b* passes through the liquid guiding structure 30 to lead out the second liquid through the end of the second pipe section 20*b* extending into the second liquid storage structure 200.

In this embodiment, the liquid guiding structure 30 includes a liquid guiding opening 30*a* and a liquid guiding sleeve 30*b*. The liquid guiding opening 30*a* is defined on the structural wall of the second liquid storage structure 200, and the liquid guiding opening 30*a* is positioned opposite to the side wall of the first liquid storage structure 100. One end of the liquid guiding sleeve 30*b* is connected to the side wall of the first liquid storage structure 100, and the other end of the liquid guiding sleeve 30*b* communicates with the liquid guiding opening 30*a*. The wall of the liquid guiding sleeve 30*b* defines a first communication opening 302*b* and a second communication opening 304*b*. The first communication opening 302*b* communicates with the liquid inlet pipe 10*b*, and the curved transition of the first pipe section 20*c* and the second pipe section 20*b* is just suitable for the liquid guiding structure 30 to smoothly lead out the second liquid through the second communication opening 304*b* and the liquid guiding opening 30*a*. More specifically, the liquid guiding structure 30 is centrally arranged along the height direction of the liquid storage device.

As shown in FIG. 4, the second liquid enters the second liquid storage structure 200 through the liquid inlet structure 10. The second liquid storage structure 200 spreads out and stores the second liquid. Due to the gravity of the second liquid, the second liquid storage structure 200 on the whole is close to the bottom wall of the first liquid storage structure 100. As shown in FIG. 3, as the second liquid is led out of the second liquid storage structure 200 through the liquid outlet structure 20, and the first liquid enters the first liquid storage structure 100 through the liquid inlet 70 of the first liquid storage structure 100, the first liquid forms a buoyancy support for the second liquid storage structure 200, and the second liquid storage structure 200 gradually moves away from the bottom wall of the first liquid storage structure 100. The first liquid may hold up the second liquid storage structure 200 such that the second liquid storage structure 200 and the liquid guiding structure 30 are approximately at the same horizontal plane, thereby reducing the load of the liquid guiding opening 30*a* and facilitating the outflow of all the second liquid in the second liquid storage structure 200. The direction "a" shown in FIG. 3 and FIG. 4 is the direction in which the first liquid enters the first liquid storage structure 100 from the liquid inlet 70, and the direction "b" is the buoyancy supporting direction of the first liquid to the second liquid storage structure.

Figure 5:
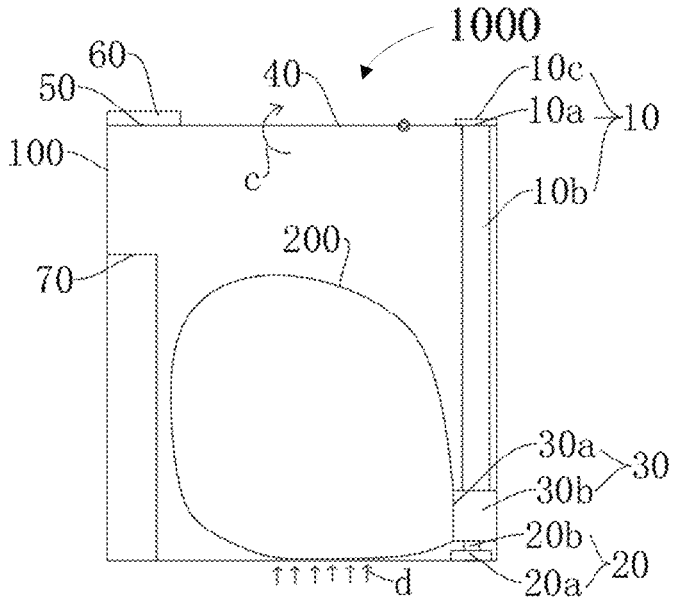
FIG. 5 is a schematic view of the liquid storage device according to some embodiments of the present disclosure.

As shown in FIG. 5, in one embodiment, the liquid inlet structure 10 includes a liquid inlet opening 10*a*, and the liquid inlet opening 10*a* is defined on the side wall of the first liquid storage structure 100. The liquid outlet structure 20 includes a liquid outlet opening 20*a* and a liquid outlet pipe 20*b*. The liquid outlet opening 20*a* is defined on the bottom wall of the first liquid storage structure 100, and the liquid outlet pipe 20*b* extends linearly along the height direction of the liquid storage device 1000. One end of the liquid outlet pipe 20*b* communicates with the liquid outlet opening 20*a*, and the other end of the liquid outlet pipe 20*b* communicates with the liquid guiding structure 30.

In this embodiment, the liquid guiding structure 30 includes a liquid guiding opening 30*a* and a liquid guiding sleeve 30*b*. The liquid guiding opening 30*a* is defined on the structural wall of the second liquid storage structure 200, and the liquid guiding opening 30*a* is positioned opposite to the side wall of the first liquid storage structure 100. One end of the liquid guiding sleeve 30*b* communicates with the liquid inlet opening 10*a*, and the other end of the liquid guiding sleeve 30*b* communicates with the liquid guiding opening 30*a*. The wall of the liquid guiding sleeve 30*b* defines a communication opening, and the communication opening communicates with the liquid inlet pipe 10*b*. More specifically, in this embodiment, the liquid guiding structure 30 is positioned close to the bottom wall of the first liquid storage structure 100.

As shown in FIG. 5, the second liquid enters the second liquid storage structure 200 through the liquid inlet structure 10, and the second liquid storage structure 200 spreads out and stores the second liquid. Due to the gravity of the second liquid, the second liquid storage structure 200 on the whole is supported on the bottom wall of the first liquid storage structure 100. As the second liquid is led out of the second liquid storage structure 200 through the liquid outlet structure 20, and the first liquid enters the first liquid storage structure 100 through the liquid inlet 70 of the first liquid storage structure 100, the bottom wall of the first liquid storage structure 100 still supports the second liquid storage structure 200, and continues to hold up the second liquid storage structure 200. In this way, the second liquid storage structure 200 and the liquid guiding structure 30 are approximately at the same horizontal plane, thereby reducing the load of the liquid guiding opening 30*a* and facilitating the outflow of all the second liquid in the second liquid storage structure 200. The direction "d" shown in FIG. 5 is the supporting direction of the bottom wall of the first liquid storage structure 100 to the second liquid storage structure 200.

In the embodiments of the present disclosure, the second liquid storage structure 200 includes a continuous curved sidewall, so as to maximize the volume variability of the second liquid storage structure 200.

In the embodiments of the present disclosure, the material of the second liquid storage structure 200 is any of the following:

modified thermoplastic polyurethane elastomer rubber;
polyester resin;
silica gel;
PP/PVC/PE.

The modified thermoplastic polyurethane elastomer rubber is commonly known as modified TP, and the polyester resin is commonly known as PET.

In one embodiment, the second liquid storage structure 200 is a liquid storage bag or a liquid storage capsule.

As shown in FIG. 1 to FIG. 5, in the embodiments of the present disclosure, the top wall of the first liquid storage structure 100 defines a dirt cleaning opening. A cover 40 for the dirt cleaning opening is movably arranged on the top wall, and the cover 40 for the dirt cleaning opening is configured to close or open the dirt cleaning opening. The operator may clean the inside of the first liquid storage structure 100 through the dirt cleaning opening. The direction "c" shown in FIG. 1 to FIG. 5 is the hinge rotation direction of the cover for the dirt cleaning opening.

Further, the cover 40 for the dirt cleaning opening described above is provided with a liquid pouring opening 50, and the cover 40 for the dirt cleaning opening is movably provided with a covering piece 60 for the liquid pouring opening 50. The covering piece 60 for the liquid pouring opening 50 may close or open the liquid pouring opening 50, such that the operator may tilt the first liquid storage structure 100 and pour out the first liquid therein through the liquid pouring opening 50.

In the liquid storage device 1000, the second liquid storage structure 200 is positioned inside the first liquid storage structure 100, the second liquid may be stored in the second liquid storage structure 200, and the first liquid may be stored in the space between the structural wall of the first liquid storage structure 100 and the structural wall of the second liquid storage structure 200. Since the second liquid storage structure 200 has a flexible structural wall and a variable volume, the volume of the second liquid storage structure 200 is variable. With the decrease of the second liquid in the second liquid storage structure 200, the volume of the second liquid storage structure 200 is reduced, while the storage space between the structural wall of the second liquid storage structure 200 and the structural wall of the first liquid storage structure 100 is increased, such that the liquid storage device 1000 may store more first liquid. On the contrary, with the increase of the second liquid in the second liquid storage structure 200, the volume of the second liquid storage structure 200 increases, while the storage space between the structural wall of the second liquid storage structure 200 and the structural wall of the first liquid storage structure 100 decreases, such that the liquid storage device 1000 can store more second liquid.

The liquid storage device 1000 provided by the embodiments of the present disclosure may be applied to the cleaning apparatus, such as a cleaning robot for mopping or washing floor, or a station for maintaining cleaning robots. For example, the first liquid is selected as waste liquid and the second liquid is selected as clear water. Before using the cleaning apparatus for operation, the clear water is stored in the second liquid storage structure 200 of the liquid storage device 1000, and the storage amount of clear water may be maximized. During the operation of the cleaning apparatus, the consumption of clear water gradually increases, the volume of the second liquid storage structure 200 gradually decreases, and the storage space between the structural wall of the second liquid storage structure 200 and the structural wall of the first liquid storage structure 100 gradually increases. The amount of waste liquid produced is right the amount of clear water used, such that the waste liquid may be stored in the storage space between the structural wall of the second liquid storage structure 200 and the structural wall of the first liquid storage structure 100.

Figure 6:
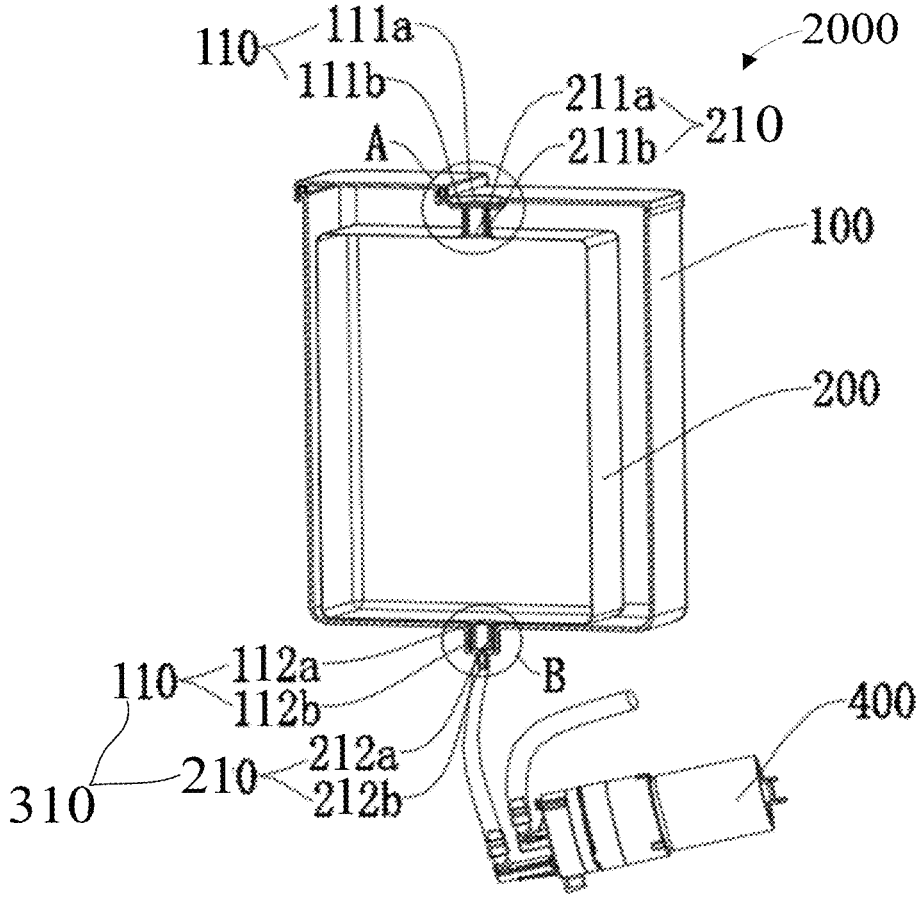
FIG. 6 is a cross-sectional view of a liquid storage device according to another embodiment of the present disclosure.

FIG. 6 is a schematic structural diagram of a liquid storage device 2000 provided by another embodiment of the present disclosure. The liquid storage device 2000 of FIG. 6 is similar to the liquid storage device 1000 of FIGS. 1-5, except that the liquid storage device 2000 includes a liquid guiding assembly 310, and the liquid guiding assembly 310 includes a first liquid guiding structure 110 and a second liquid guiding structure 210. The first liquid guiding structure 110 communicates with the second liquid guiding structure 210, and the second liquid can flow into or out of the second liquid storage structure 200 through the first liquid guiding structure 110 and the second liquid guiding structure 210.

In some embodiments, the liquid storage device 2000 includes a first liquid storage structure 100 and at least two second liquid storage structures 200, and the at least two second liquid storage structure 200 may be arranged inside the first liquid storage structure 100 according to the use orientation. For example, when the liquid storage device 2000 is applied to a larger cleaning apparatus, at least two floor mopping or washing structures may be uniformly distributed around the liquid storage device 2000, and the at least two floor mopping or washing structures are respectively arranged in different orientations of the liquid storage device 2000, that is, the above-mentioned use orientation. Each second liquid storage structure 200 is correspondingly connected to a respective one of the at least two floor mopping or washing structures, and delivers the second liquid nearby to the corresponding floor mopping or washing structure.

In some embodiments, the liquid storage device 2000 includes a first liquid storage structure 100, a second liquid storage structure 200 and a third liquid storage structure, wherein the third liquid storage structure has flexibility and a variable volume. The space between the structural wall of the first liquid storage structure 100 and the structural wall of the second liquid storage structure 200 is used to store the first liquid, the space between the structural wall of the third liquid storage structure and the structural wall of the first liquid storage structure 100 is used to store the first liquid, the second liquid storage structure 200 is used to store the second liquid, and the third liquid storage structure is used to store a third liquid. The liquid guiding assembly 310 includes a fourth liquid guiding structure which communicates with the first liquid guiding structure 110, and the third liquid can flow into and out of the third liquid storage structure through the fourth liquid guiding structure and the first liquid guiding structure 110. Of course, in this embodiment, the liquid guiding assembly 310 may include at least two first liquid guiding structures 110 for communicating with the second liquid guiding structure 210 and the fourth liquid guiding structure respectively.

The liquid storage device 2000 provided by the embodiment of the present disclosure is preferably applied to a cleaning apparatus. For example, the cleaning apparatus may preferably be a cleaning robot for cleaning mopping or washing floor, or a station for maintaining cleaning robot, the first liquid may preferably be waste liquid, and the second liquid may preferably be clear water. Before using the cleaning apparatus for operation, clear water is stored in the second liquid storage structure 200 of the liquid storage device 2000, and the storage amount of the clear water may be maximized. During the operation of the cleaning apparatus, the consumption of clear water is gradually increases, the volume of the second liquid storage structure 200 gradually decreases, and the storage space between the structural wall of the second liquid storage structure 200 and the structural wall of the first liquid storage structure 100 gradually increases. The amount of waste liquid produced is right the amount of clear water used, such that the waste liquid may be stored in the storage space between the structural wall of the second liquid storage structure 200 and the structural wall of the first liquid storage structure 100. When the liquid storage device 2000 includes a third liquid storage structure, the third liquid is preferably a disinfectant.

Figure 7:
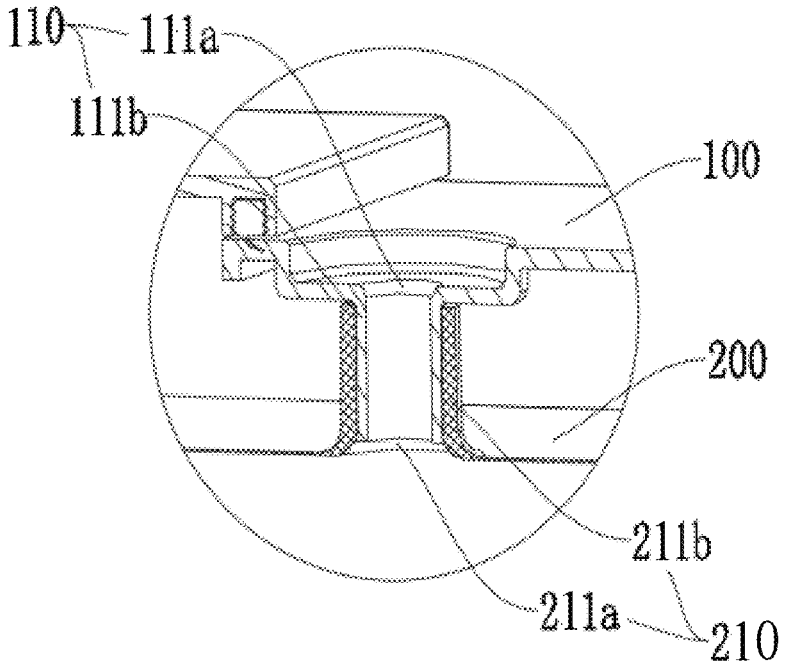
FIG. 7 is an enlarged view of part A in FIG. 6.
Figure 8:
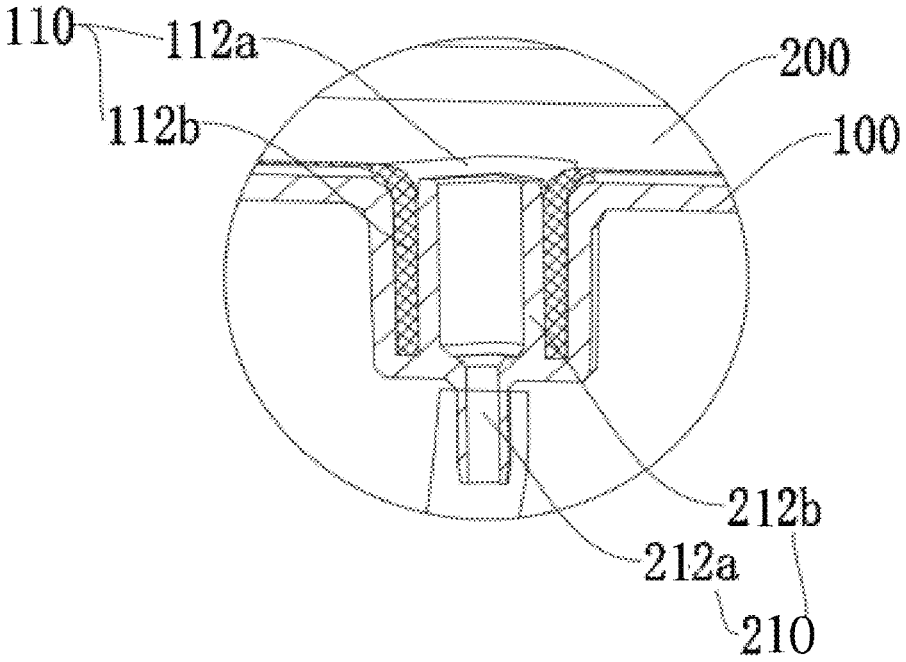
FIG. 8 is an enlarged view of part B in FIG. 6.

FIG. 7 is an enlarged view of part A in FIG. 6, and FIG. 8 is an enlarged view of part B in FIG. 6. Referring to FIG. 6 to FIG. 8, in one embodiment, the inflow and outflow of the second liquid respectively adopt separate flow channels. Specifically, the first liquid guiding structure 110 includes a first liquid inlet opening 111*a* and a first liquid outlet opening 112*a*, and the second liquid guiding structure 210 includes a second liquid inlet opening 211*a* and a second liquid outlet 212*a*. The first liquid inlet opening 111*a* communicates with the second liquid inlet opening 211*a*, and the second liquid can flow into the second liquid storage structure 200 through the first liquid inlet opening 111*a* and the second liquid inlet opening 211*a*. In some embodiments, a pump 400 as a drive is not additionally installed outside the first liquid guiding structure 110, and the operator may directly pour the second liquid into the second liquid storage structure 200 through the first liquid guiding structure 110. The first liquid outlet opening 112*a* communicates with the second liquid outlet opening 212*a*, and the second liquid can flow out of the second liquid storage structure 200 through the first liquid outlet opening 112*a* and the second liquid outlet 212*a*. In some embodiments, a pump 400 as a drive is additionally provided outside the second liquid guiding structure 210, and the second liquid is pumped out of the second liquid storage structure 200 by the drive of the pump 400.

More specifically, the first liquid guiding structure 110 further includes a first liquid inlet sleeve part 111*b* extending from the edge of the first liquid inlet opening 111*a*, and the second liquid guiding structure 210 further includes a second liquid inlet sleeve part 211*b* extending from the edge of the second liquid inlet opening 211*a*. The first liquid inlet sleeve part 111*b* is sleeved in the second liquid inlet sleeve part 211*b* to make the first liquid inlet opening 111*a* communicate with the second liquid inlet opening 211*a* along a axial straight line, and completely isolate the communication channel from the storage space of the first liquid. Additionally/alternatively, the first liquid guiding structure 110 further includes a first liquid outlet sleeve part 112*b* extending from the edge of the first liquid outlet opening 112*a*, and the second liquid guiding structure 210 further includes a second liquid outlet sleeve part 212*b* extending from the edge of the second liquid outlet 212*a*. The second liquid outlet sleeve part 212*b* is sleeved in the first liquid outlet sleeve part 112*b* to make the first liquid outlet opening 112*a* communicate with the second liquid outlet opening 212*a* along an axial straight line, and completely isolate the communication channel from the storage space of the first liquid.

In one embodiment, the inflow and outflow of the second liquid uses one flow channel. The first liquid guiding structure 110 is a first liquid guiding opening. The second liquid guiding structure 210 is a second liquid guiding opening. The first liquid guiding opening communicates with the second liquid guiding opening, and the second liquid can flow into the second liquid storage structure 200 through the first liquid guiding opening and the second liquid guiding opening. Alternatively, the second liquid can flow out of the second liquid storage structure 200 through the first liquid guiding opening and the second liquid guiding opening. In some embodiments, the pump 400 as a drive is additionally provided outside the liquid storage device 2000, and the second liquid can be pumped into the second liquid storage structure 200 by the drive of the pump 400, or the second liquid can be pumped out of the second liquid storage structure 200 by the drive of the pump 400.

Based on that separate flow channels are adopted respectively for inflow and outflow of the second liquid, in one embodiment, the first liquid inlet opening 111*a* is defined on the top wall of the first liquid storage structure 100, and the second liquid inlet opening 211*a* is defined on the top wall of the second liquid storage structure 200, thereby making it convenient for the operator to pour the second liquid into the second liquid storage structure 200. The first liquid outlet opening 112*a* is defined on the bottom wall of the first liquid storage structure 100, and the second liquid outlet opening 212*a* is defined on the bottom wall of the second liquid storage structure 200. The second liquid may flow toward the pump 400 as a drive by gravity to reduce the power consumption of the pump 400.

In one embodiment, the cross sections of the first liquid storage structure 100 and the second liquid storage structure 200 are both rectangular, and the storage space of the rectangle is relatively large, but the spatial variability of the rectangle is relatively small. In other embodiments, the structural shapes of the first liquid storage structure 100 and the second liquid storage structure 200 may be the same or different. For example, the structures of the first liquid storage structure 100 and the second liquid storage structure 200 may be circular, oval, cylindrical, bowl-shaped and the like.

In one embodiment, the longitudinal dimension of the second liquid storage structure 200 is larger than the transverse dimension of the second liquid storage structure 200, such that the whole liquid storage device 2000 presents a vertical structure.

Figure 9:
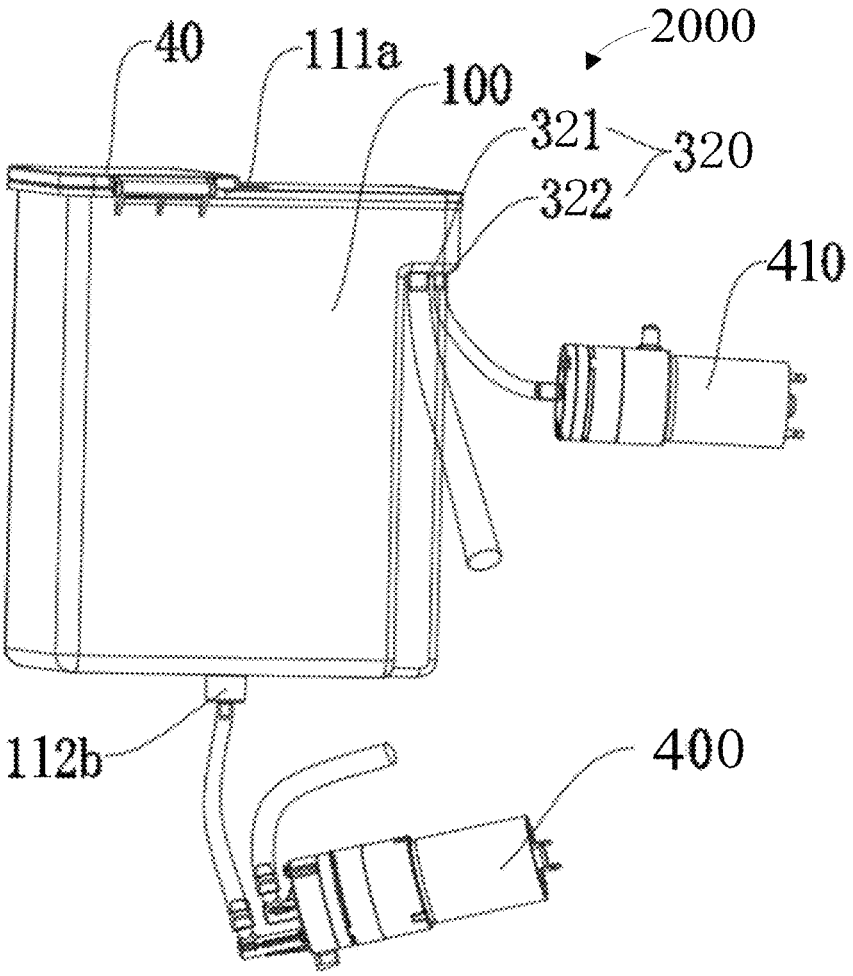
FIG. 9 is a schematic view of the liquid storage device of FIG. 6.
Figure 10:
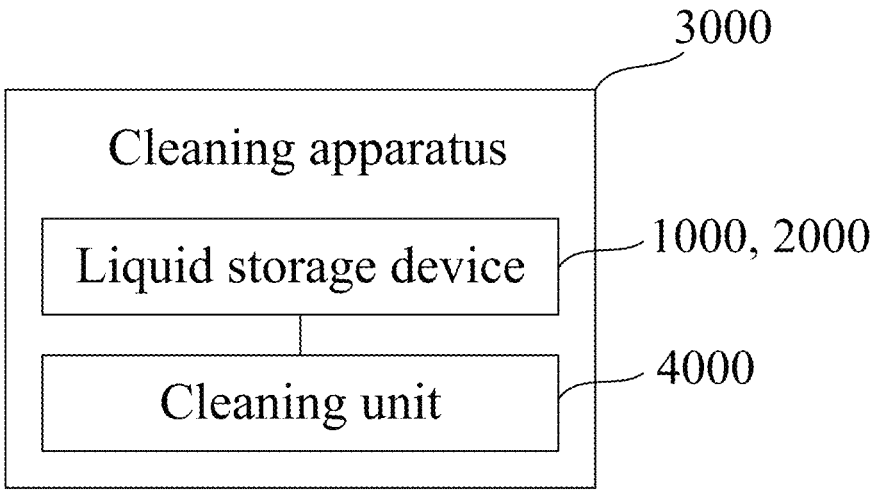
FIG. 10 is a schematic view of a cleaning apparatus according to still another embodiment of the present disclosure.

Referring to FIG. 9, in one embodiment, the first liquid storage structure 100 includes a third liquid guiding structure 320, and the third liquid guiding structure 320 includes a liquid inlet opening 321 and an air sucking opening 322. The air sucking opening 322 is configured to externally connect an air pumping mechanism 410. The air pumping mechanism 410 is configured to pump air from the first liquid storage structure 100 through the air sucking opening 322, so as to generate a negative pressure in the first liquid storage structure 100, such that the first liquid enters the first liquid storage structure 100 through the liquid inlet opening 321.

In the liquid storage device 2000, the second liquid storage structure 200 is positioned inside the first liquid storage structure 100, the second liquid may be stored in the second liquid storage structure 200, and the first liquid may be stored in the space between the structural wall of the first liquid storage structure 100 and the structural wall of the second liquid storage structure 200. Since the second liquid storage structure 200 has a flexible structural wall and a variable volume, the volume of the second liquid storage structure 200 is variable. With the decrease of the second liquid in the second liquid storage structure 200, the volume of the second liquid storage structure 200 is reduced, while the storage space between the structural wall of the second liquid storage structure 200 and the structural wall of the first liquid storage structure 100 is increased, such that the liquid storage device 2000 may store more first liquid. On the contrary, with the increase of the second liquid in the second liquid storage structure 200, the volume of the second liquid storage structure 200 increases, while the storage space between the structural wall of the second liquid storage structure 200 and the structural wall of the first liquid storage structure 100 decreases, such that the liquid storage device 2000 can store more second liquid.

Another objective of the embodiments of the present disclosure is to provide a cleaning apparatus 3000, and the cleaning apparatus 3000 includes the liquid storage device 1000, 2000 as described above and a cleaning unit 4000. The cleaning apparatus 3000 may be a cleaning robot for mopping or washing floor, or a station for maintaining cleaning robots. The first liquid described above may be waste liquid and the second liquid described above may be clear water. When the cleaning apparatus 3000 is a cleaning robot, and the cleaning robot includes a cleaning unit 4000 configured to mop or wash floor. During the cleaning unit 4000 is mopping or washing floor, the clear water is supplied from the second liquid storage structure 200 to the cleaning unit 4000, the cleaning unit 4000 mops or washes the floor, meanwhile waste liquid is generated and is sucked into the first liquid storage structure 100. When the cleaning apparatus 3000 is a station for maintaining cleaning robots, and the station includes a cleaning unit 4000 configured to clean cleaning pieces of the cleaning robots. During the cleaning robots are docking with the station, the clear water is supplied from the second liquid storage structure 200 to the cleaning unit 4000, the cleaning unit 4000 cleans the cleaning pieces of the cleaning robots, meanwhile waste liquid is generated and is sucked into the first liquid storage structure 100.

What described above are only the exemplary embodiments of the present disclosure, but are not intended to limit the scope of the present disclosure. Under the concept of the present disclosure, any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. A liquid storage device, comprising:

a first liquid storage structure, a second liquid storage structure, and a liquid guiding assembly;

the second liquid storage structure arranged inside the first liquid storage structure, the second liquid storage structure being flexible and comprising a variable volume; a space between a structural wall of the first liquid storage structure and a structural wall of the second liquid storage structure being configured to store a first liquid, and the second liquid storage structure being configured to store a second liquid;

the second liquid capable of flowing into or flowing out of the second liquid storage structure through the liquid guiding assembly;

wherein the liquid guiding assembly comprises a liquid inlet structure, a liquid outlet structure, and a liquid guiding structure;

the liquid inlet structure communicates with the liquid guiding structure, and the second liquid is capable of flowing into the second liquid storage structure through the liquid inlet structure and the liquid guiding structure;

the liquid outlet structure communicates with the liquid guiding structure, and the second liquid is capable of flowing out of the second liquid storage structure through the liquid outlet structure and the liquid guiding structure.

2. The liquid storage device of claim 1, wherein the liquid inlet structure comprises a liquid inlet opening and a liquid inlet pipe, the liquid inlet opening is defined on the structural wall of the first liquid storage structure, one end of the liquid inlet pipe communicates with the liquid inlet opening, and the other end of the liquid inlet pipe communicates with the liquid guiding structure; and/or the liquid outlet structure comprises a liquid outlet opening and a liquid outlet pipe, the liquid outlet opening is defined on the structural wall of the first liquid storage structure, one end of the liquid outlet pipe communicates with the liquid outlet opening, and the other end of the liquid outlet pipe communicates with the liquid guiding structure.

3. The liquid storage device of claim 2, wherein the liquid inlet opening is defined on a top wall of the first liquid storage structure.

4. The liquid storage device of claim 2, wherein the liquid outlet opening is defined on a bottom wall of the first liquid storage structure.

5. The liquid storage device of claim 1, wherein the liquid outlet structure comprises a liquid outlet opening and a liquid outlet pipe, the liquid outlet opening is defined on the structural wall of the first liquid storage structure, one end of the liquid outlet pipe communicates with the liquid outlet opening, and the other end of the liquid outlet pipe passes through the liquid guiding structure and extends into the second liquid storage structure.

6. The liquid storage device of claim 1, wherein the liquid guiding structure comprises a liquid guiding opening and a liquid guiding sleeve, and the liquid guiding opening is defined on the structural wall of the second liquid storage structure and is positioned opposite to the structural wall of the first liquid storage structure;

one end of the liquid guiding sleeve is connected to the structural wall of the first liquid storage structure, and the other end of the liquid guiding sleeve communicates with the liquid guiding opening;

the liquid guiding sleeve defines a first communication opening and a second communication opening, the first communication opening communicates with the liquid inlet structure, and the second communication opening communicates with the liquid outlet structure.

7. The liquid storage device of claim 6, wherein the liquid guiding structure is centrally arranged along a height direction of the liquid storage device; or the liquid guiding structure is arranged close to a bottom wall of the first liquid storage structure.

8. The liquid storage device of claim 1, wherein the second liquid storage structure comprises a continuous curved sidewall.

9. The liquid storage device of claim 1, wherein a material of the second liquid storage structure comprises modified thermoplastic polyurethane elastomer rubber, polyester resin or silica gel.

10. The liquid storage device of claim 1, wherein the first liquid is waste liquid and the second liquid is clear water.

11. The liquid storage device of claim 1, wherein the second liquid storage structure comprises a liquid storage bag or a liquid storage capsule.

12. A liquid storage device, comprising:

a first liquid storage structure, a second liquid storage structure, and a liquid guiding assembly;

the second liquid storage structure arranged inside the first liquid storage structure, the second liquid storage structure being flexible and comprising a variable volume; a space between a structural wall of the first liquid storage structure and a structural wall of the second liquid storage structure being configured to store a first liquid, and the second liquid storage structure being configured to store a second liquid;

the second liquid capable of flowing into or flowing out of the second liquid storage structure through the liquid guiding assembly;

wherein the liquid guiding assembly comprises a first liquid guiding structure and a second liquid guiding structure, the first liquid guiding structure communicates with the second liquid guiding structure, and the second liquid is capable of flowing into or flowing out of the second liquid storage structure through the first liquid guiding structure and the second liquid guiding structure;

wherein the first liquid guiding structure comprises a first liquid inlet opening and a first liquid outlet opening, and the second liquid guiding structure comprises a second liquid inlet opening and a second liquid outlet opening;

the first liquid inlet opening communicates with the second liquid inlet opening, the second liquid is capable of flowing into the second liquid storage structure through the first liquid inlet opening and the second liquid inlet opening;

the first liquid outlet opening communicates with the second liquid outlet opening, and the second liquid is capable of flowing out of the second liquid storage structure through the first liquid outlet opening and the second liquid outlet opening.

13. The liquid storage device of claim 12, wherein the first liquid inlet opening is defined on a top wall of the first liquid storage structure, and the second liquid inlet opening is defined on a top wall of the second liquid storage structure;

the first liquid outlet opening is defined on a bottom wall of the first liquid storage structure, and the second liquid outlet opening is defined on a bottom wall of the second liquid storage structure.

14. The liquid storage device of claim 12, wherein the first liquid guiding structure further comprises a first liquid inlet sleeve part extending from an edge of the first liquid inlet opening, the second liquid guiding structure further comprises a second liquid inlet sleeve part extending from an edge of the second liquid inlet opening, and the first liquid inlet sleeve part is sleeved in the second liquid inlet sleeve part; and/or the first liquid guiding structure further comprises a first liquid outlet sleeve part extending from an edge of the first liquid outlet opening, the second liquid guiding structure further comprises a second liquid outlet sleeve part extending from an edge of the second liquid outlet opening, and the second liquid outlet sleeve part is sleeved in the first liquid outlet sleeve part.

15. The liquid storage device of claim 12, wherein cross sections of the first liquid storage structure and the second liquid storage structure are all rectangular.

16. The liquid storage device of claim 15, wherein a longitudinal dimension of the second liquid storage structure is larger than a transverse dimension of the second liquid storage structure.

17. A liquid storage device, comprising:

a first liquid storage structure, a second liquid storage structure, and a liquid guiding assembly;

the second liquid storage structure arranged inside the first liquid storage structure, the second liquid storage structure being flexible and comprising a variable volume; a space between a structural wall of the first liquid storage structure and a structural wall of the second liquid storage structure being configured to store a first liquid, and the second liquid storage structure being configured to store a second liquid;

the second liquid capable of flowing into or flowing out of the second liquid storage structure through the liquid guiding assembly;

wherein the liquid guiding assembly comprises a first liquid guiding structure and a second liquid guiding structure, the first liquid guiding structure communicates with the second liquid guiding structure, and the second liquid is capable of flowing into or flowing out of the second liquid storage structure through the first liquid guiding structure and the second liquid guiding structure;

wherein the first liquid storage structure comprises a third liquid guiding structure, and the third liquid guiding structure comprises a liquid inlet opening and an air sucking opening; the liquid storage device comprises an air pumping mechanism, and the air sucking opening is connected to the air pumping mechanism, the air pumping mechanism is configured to pump air from the first liquid storage structure through the air sucking opening, so as to generate a negative pressure in the first liquid storage structure, such that the first liquid enters the first liquid storage structure through the liquid inlet opening.

18. A cleaning apparatus, comprising the liquid storage device of claim 1 and a cleaning unit, the second liquid capable of being supplied from the second liquid storage structure through the liquid guiding assembly to the cleaning unit.

* * * * *